US006086433A

United States Patent [19]

Hils et al.

[11] Patent Number: 6,086,433

[45] Date of Patent: Jul. 11, 2000

[54] PLUG SOCKET FOR ELECTRICALLY CONNECTING A CABLE OR THE LIKE HAVING A STRIPPED WIRE PORTION WITH A FLAT PLUG

[75] Inventors: Jean-Blaise Hils, Reichsfeld; Claude Lengert, Obernai, both of France

[73] Assignee: Contact GmbH & Co. KG, Germany

[21] Appl. No.: 09/157,124

[22] Filed: Sep. 18, 1998

[30] Foreign Application Priority Data

Sep. 18, 1997 [DE] Germany ..... 297 16 767 U

[51] Int. Cl.[7] ..... H01R 11/12

[52] U.S. Cl. ..... 439/849; 439/850; 439/877

[58] Field of Search ..... 439/849, 850, 439/852, 857, 858, 859, 861, 862, 268, 730, 266, 269, 270, 877, 881, 882, 441

[56] References Cited

U.S. PATENT DOCUMENTS

| | | | |
|---|---|---|---|
| 1,476,028 | 12/1923 | Berge et al. | 439/854 |
| 2,747,171 | 5/1956 | Martines | 339/276 |
| 3,521,224 | 7/1970 | Spooren | 439/730 |
| 3,771,111 | 11/1973 | Pritulsky | 439/855 |
| 5,525,070 | 6/1996 | Axelsson | 439/268 |

FOREIGN PATENT DOCUMENTS

| | | |
|---|---|---|
| 1816764 | 5/1960 | Germany . |
| 1190537 | 7/1962 | Germany . |
| 2024364 | 5/1970 | Germany . |
| 29513221 | 11/1995 | Germany . |
| 340876 | 5/1955 | Switzerland . |
| 907316 | 3/1960 | United Kingdom . |
| 908399 | 4/1960 | United Kingdom . |

*Primary Examiner*—Paula Bradley
*Assistant Examiner*—Alex Gilman
*Attorney, Agent, or Firm*—Robert W. Becker & Associates

[57] ABSTRACT

A plug socket is provided for electrically connecting a cable or the like having a stripped wire portion with a flat plug. The plug socket comprises a sleeve portion having an approximately U-shaped cross sectional configuration and having side walls that are bent inwardly and between which a flat plug is insertable from one end. The plug socket also comprises a crimp portion that is provided with first and second clamping strips, wherein the first clamping strip is provided for crimping the conductive stripped wire portion of the cable, and the second clamping strip is provided for crimping insulation of the cable. In the vicinity of the first clamping strip, a hook-shaped projection is provided that, depending on its position, during crimping forms a receiving area for an end portion or a longitudinal side of a free edge of the first clamping strip.

11 Claims, 1 Drawing Sheet

PLUG SOCKET FOR ELECTRICALLY CONNECTING A CABLE OR THE LIKE HAVING A STRIPPED WIRE PORTION WITH A FLAT PLUG

BACKGROUND OF THE INVENTION

The present invention relates to a plug socket for electrically connecting a cable or the like having a stripped wire portion with a flat plug, where the plug socket comprises a sleeve portion having an approximately U-shaped cross-sectional configuration and having side walls that are bent inwardly and between which a flat plug is insertable from one end, and further comprising a crimp portion that is provided with first and second claw-shaped clamping sections, wherein the first clamping section is provided for crimping the conductive stripped wire cable portion, and the second clamping strip is provided for crimping the insulation of a cable.

Many embodiments of such plug sockets are known and are widely used primarily in the "white" household appliance industry. The plug sockets, which serve as cable sockets or terminals, are connected to an electrical conductor by crimping, in other words by being squeezed together and deformed; this provides an electrically good conducting and, due to the solder-free manufacture, also a relatively corrosion resistant connection. A flat plug that is to be contacted is accommodated by the sleeve portion, which is provided with an interlocking mechanism in the form of a detent or a point-type raised portion, which cooperates with an opening in the flat plug. The sleeve portion essentially comprises a base plate and two oppositely disposed and projecting side walls that are bent over in a curved manner over the base plate in order to achieve a linear contact on the upper side of a flat plug. The known plug sockets primarily differ from one another with regard to the structural shape of the base plate and the bent side walls, the purpose of which is to minimize frictional forces during insertion of a flat plug while still achieving adequate reliability of the electrical connection.

However, a drawback of the heretofore known plug sockets is that despite a reliable contact of the plug socket and a flat plug, the electrical connection is frequently adversely affected by loosening of the cable, which is secured by crimping. The cause for this is the tensile stress of the crimp connection caused by the movablility of a cable, as a result of which the crimp connection can again be released. It is therefore known in the state of the art to provide the free end of a clamping strip with a projection that during the crimping is introduced into a rectangular opening of the crimping portion and is compressed on the underside of the crimping portion, resulting in an interlocking. The drawback of this is that due to the opening not only does a weakening of the strength of the plug socket occur, but also significant heating-up in the contact zone when high currents are present due to the transition resistance, which is increased by the opening. A further drawback is that non-plated contact regions of the opening come into contact with the normally plated upper surface, which can lead to unfavorable contact corrosion. A further drawback of the known plug sockets is that when tensile stress results, for example when the flat plug is pulled out, there occurs at the transition location between the cable insulation and the exposed or stripped wire portion a bending or deformation of the clamping strip that crimps the stripped wire portion; this can lead to shearing off of the stripped wire portion at the insulation sheathing.

It is therefore an object of the present invention to improve a plug socket of the aforementioned general type such that a reliable interlocking and an increased holding force of the crimp connection of a cable is provided, while at the same time such a plug socket is easy and economical to produce.

BRIEF DESCRIPTION OF THE DRAWINGS

This object, and other objects and advantages of the present invention, will appear more clearly from the following specification in conjunction with the accompany schematic drawings, in which.

SUMMARY OF THE INVENTION

Figure 1:
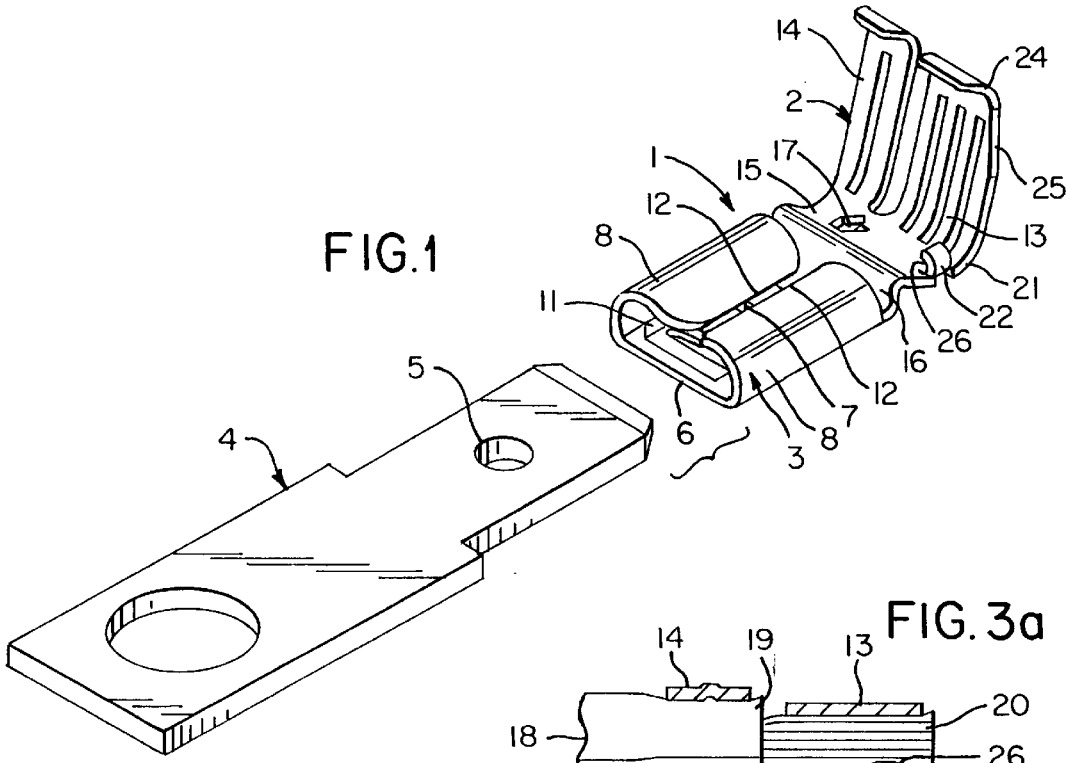
FIG. 1 is a perspective view of one exemplary embodiment of the inventive plug socket and a flat plug.

The object of the present invention is inventively realized by a plug socket characterized primarily in that in the vicinity of the first clamping strip of the crimp portion a hook-shaped projection is provided that, depending upon its position, during crimping forms a receiving means for an end portion or a longitudinal side of the free edge of the first clamping strip.

It is particularly advantageous if after the crimping the free edge of the first clamping strip is rolled under the hook-shaped projection and is deformed therewith, since then a plug socket is provided that due to a reliable interlocking prevents an opening of the crimp of a connected cable since during the crimping process a portion of the free edge of the first clamping strip is pressed together with the hook-shaped projection. In this way, the crimp is protected against opening in a positive and frictional manner. A further advantage is that the crimp portion has no opening, so that a low transition resistance results that also enables a transmission of high currents with only little heating up.

Pursuant to a further specific embodiment of the present invention, the hook-shaped projection is disposed close to the front edge of the crimp portion that faces the end face of a cable in order to achieve a structurally straightforward and particularly easy to install configuration. In this connection, it is advantageous if the hook-shaped projection is oriented orthogonally to the front edge of the crimp portion and parallel to the free edge at the end face of the first clamping strip, so that the first clamping strip can be rolled under the projection in an unlimited manner, which permits use of the plug socket with stripped wire cable portions having very different diameters. Pursuant to another advantageous specific embodiment, the hook-shaped projection is formed by cutting in and bending over a portion of the front edge of the crimp portion, so that also with this measure a particularly straightforward and economical manufacture is achieved.

The hook-shaped projection is preferably set back or recessed from the front edge of the crimp portion, and the free edge of the first clamping strip has a portion that extends at an incline relative to the front edge of the crimp portion and that permits an arrangement of the hook-shaped projection within the crimping range of the clamping strip, as a result of which during the crimping process the projection is squeezed and a reliable interlocking of the crimp is achieved.

Pursuant to a preferred specific embodiment of the present invention, the inner surface of the crimp portion, in the region between the first and second clamping strips, is provided with an abutment or stop for the end face of the insulation of a cable. This offers the advantage that the bending or deformation of the clamping strip that crimps the stripped wire cable portion relative to the insulation of the cable is prevented, so that when a tensile stress suddenly occurs, for example when the flat plug is pulled out, a holding force is achieved that is greater than that which can be achieved with the heretofore known plug sockets. The abutment or stop is expediently embodied as a projection that extends transverse to the longitudinal axis of a cable, thus ensuring a large-surface contact of the cable insulation.

In order to achieve a straightforward and economical manufacture of the stop, it is proposed pursuant to a further advantageous feature of the invention that the stop have a tongue that is cut free and bent up out of the crimp portion, so that at the same time a rapid and exact positioning of the cable that is to be secured is provided.

The transition between the sleeve portion and the crimp point is expediently bent to form an abutment surface for a flat plug that is to be inserted into the sleeve portion, thereby resulting in a simple and reliable plug connection.

It is furthermore expedient if the direction of securement of the crimp portion is orthogonal to the plug connection direction of the sleeve portion in order to ensure relief of tension during introduction or withdrawal of a flat plug. Finally, it is proposed that the crimp portion and the sleeve portion be manufactured as a single piece by bending a plated blank in order to achieve a rapid and economical manufacture while providing good electrical contact properties.

Further specific features of the present invention will be described in detail subsequently.

DESCRIPTION OF PREFERRED EMBODIMENTS

Referring now to the drawing in detail, the plug socket 1 illustrated in FIG. 1 has a crimp portion 2 and a sleeve portion 3 into which a flat plug 4 can be inserted. The flat plug 4 is provided with an opening 5 into which in the contacted state a detent 7 that is disposed on a base plate 6 of the sleeve portion 3 extends in order to form an interlocking. The sleeve portion 3 is furthermore provided with two oppositely disposed side walls 8 that extend from the base plate 6 and above the base plate are bent inwardly back toward the base plate so as to form a receiving chamber for the flat plug 6.

Figure 4:
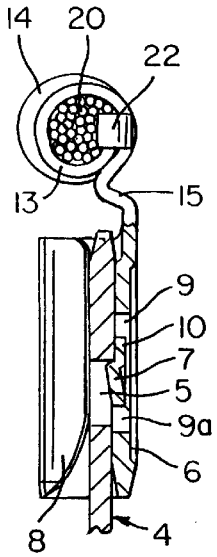
FIG. 4 is a partially cross-sectioned side view of a plug socket with a contacted flat plug and crimped cable.

As can be seen in particular from FIG. 4, to interlock the flat plug 4 the detent 7 is disposed on a securing clamp 10 that is formed by two parallel openings 9 and 9a, and that extends into the receiving chamber in a resilient manner. In order to keep the force that is necessary for inserting the flat plug 4 into the sleeve portion 3 as low as possible, the areas of contact between the flat plug 4 and the sleeve portion 3 are made linear. This is realized by providing the base plate 6 with two embossments 11 that extend parallel to one another and upon which the flat plug 4 rests. In addition, the inwardly directed free ends of the side walls 8 are rounded off on at least one side, so that in each case a longitudinal edge 12 of the side wall 8 forms a contact line with the flat plug 4.

As can also be seen from FIG. 1, the direction of securement of the crimp portion 2 is orthogonal to the direction of the plug connection of the sleeve portion 3. The crimp portion 2 has a first clamping strip 13 to crimp the conductive stripped cable wire or strand, and a second clamping strip 14 to crimp the insulation of a cable; the two clamping strips 13,14 are interconnected by a crosspiece 15. This crosspiece is bent relative to the sleeve portion 3 in such a way that an abutment surface 16 results for a flat plug 4 that is inserted into the sleeve portion 3. In the direction of securement of the crimp portion 2, the bend of the crosspiece 15 has an approximately S-shaped cross-section, that side of which that ends in the crimp portion 2 extending at a right angle from the abutment surface 16, which extends at an angle relative to the base plate 6. In this way, the bend of the crosspiece 15 additionally provides a slightly resilient connection between the crimp portion 2 and the sleeve portion 3 that in a dampening manner counteracts vibrations that occur.

Figure 3A:
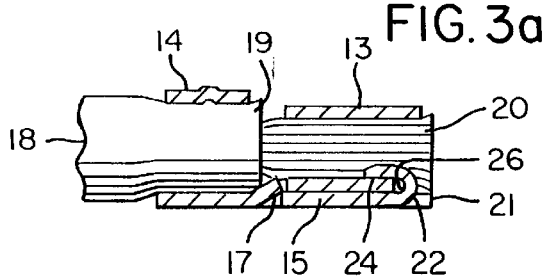
FIG. 3*a* is a cross-sectional view taken along the line IIIa—IIIa in FIG. 3.
Figure 3:
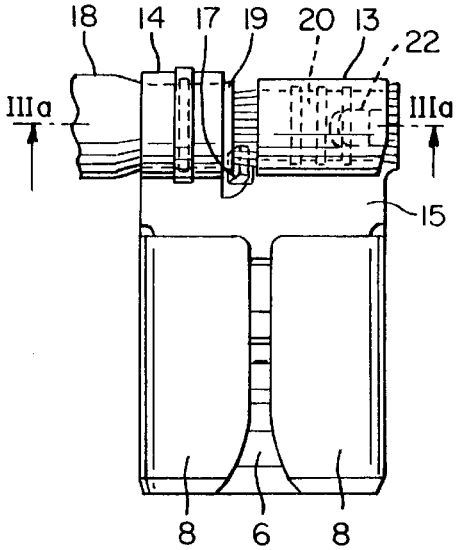
FIG. 3 is a plan view of the plug socket of FIG. 2 with a crimped cable.
Figure 2:
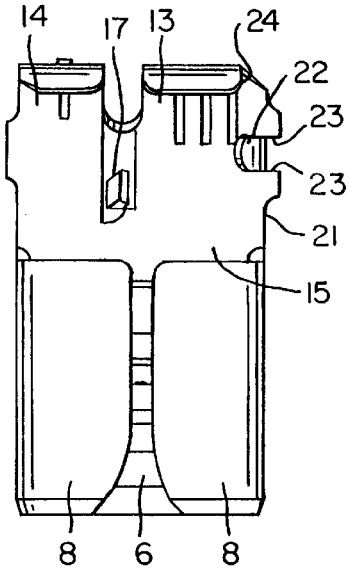
FIG. 2 is a plan view of the plug socket.

As can also be seen from FIGS. 2 and 3, the inner surface of the crimp portion 2 in the region between the first and the second clamping strips 13, 14 is provided with an abutment or step 17 that is embodied as a bent-up tongue freely cut from the crimp portion 2. A cable 18 that is to be connected to the plug socket 1 has insulation removed or stripped from one end in such a way that the end face 19 of its insulation butts against the stop 17. The height of the stop 17 is in this connection such that the exposed cable wire 20 that starts at the end face 19 of the insulation of the cable 18 can extend in an unobstructed manner to the front edge 21 of the crimp portion 2, as can be seen in FIGS. 3 and 3a. The stop 17 is furthermore embodied in such a way that its longitudinal extension extends in a transverse direction to the longitudinal axis of the cable 18, thus ensuring a large-surface engagement of the end face 19 of the insulation of the cable 18 against the stop 17. This results not only in a simple and rapid placement of the cable 18 into the plug socket 1, but also an increased holding force of the crimp portion 2 in that a deformation of the first clamping strip 13 relative to the insulation of the cable 18, and hence a loosening of the crimping of the cable 18, is prevented because it is difficult to deform the crosspiece 15.

In the vicinity of the crosspiece 15, the front edge 21 of the crimp portion 2 is bent over to form a hook-shaped projection 22, which extends orthogonally from the front edge 21 inwardly in the direction of the longitudinal axis of a cable 18 that is to be crimped; this can be seen particularly clearly in FIG. 3a. To form the hook-shaped projection 22, the contour of the front edge 21 at this location is enlarged in the manner of a projection. In addition, the inner surface of the crimp portion 2 is provided to the sides of the hook-shaped projection 22 with cuts 23 that permit the hook-shaped projection 22 to be disposed completely in the region of the first clamping strip 13 so that during crimping, an introduction and deformation of the hook-shaped projection 22 is ensured.

During crimping, an interlocking of the crimp of the cable 18 is effected; this can be seen particularly clearly in FIGS. 3*a* and 4. For this purpose, the free edge 24 of the clamping strip 13 is rolled under the hook-shaped projection 22 and subsequently deformed, as illustrated in FIG. 3*a*. An opening of the crimp is thus prevented in both a positive and frictional manner. In order to enable rolling of the free end 24 of the clamping strip 3 under the hook-shaped projection 22, the clamping strip 13 is provided with a chamfering 25 that compensates for the displacement of the contact surface 26 of the hook-shaped projection 22 and of the front edge 21 of the crimp portion 2.

The plug socket 1, which is integrally formed by stamping and forming from a metal sheet, is plated with a further metal, such as tin, in order to achieve better electrical contact properties than those possessed by the carrier material. By embodying the interlocking of the crimp of the cable 18 as a hook-shaped protection 22, there is additionally achieved that always plated surfaces come into mutual contact, while the sheared off and hence not plated edges of the free ends of the plug socket are disposed so as not to contact the plated surfaces. In this way, contact corrosion that would lead to an impairment of the conductivity of the plug socket 1 is prevented. Since the clamping strip 13 is rolled under the hook-shaped projection 22, there is also an increased thickness of material in the region of the hook-shaped projection 22 that enables a low transmission resistance and hence poor heating transmission even of high currents. Thus, the plug socket 1 ensures a reliable and permanent contact between the electrical cable 18 and the flat plug 4 in a simple manner. A plug socket 1 embodied in such a way therefore represents a solder-free method for producing good electrically conductive connections that in addition are easy and economical to produce.

The specification incorporates by reference the disclosure of German priority document 297 16 767.7 of Sep. 18, 1998.

The present invention is, of course, in no way restricted to the specific disclosure of the specification and drawings, but also encompasses any modifications within the scope of the appended

What is claimed is:

1. A plug socket for electrically connecting a cable means having a stripped wire portion with a flat plug, said plug socket comprising:

a sleeve portion having an approximately U-shaped cross sectional configuration and having side-walls that are bent inwardly and between which a flat plug is insertable from one end; and a crimp portion that is connected to said sleeve portion and is provided with a first and a second clamping strip wherein said first clamping strip is provided for crimping a stripped and hence conductive wire portion of a cable means and said second clamping strip is provided for crimping insulation of said cable means, and wherein in the vicinity of said first clamping strip a hook-shaped projection is provided that during crimping forms a receiving means for a portion of a free edge of said first clamping strip such that after a crimping process said portion of said free edge of said first clamping strip is rolled in under said hook-shaped projection into said receiving means thereof.

2. A plug socket according to claim 1, wherein a transition region between said sleeve portion and said crimp portion is a bent region forming an abutment surface for a flat plug that is to be inserted into said sleeve portion.

3. A plug socket according to claim 1, wherein a direction of securement of said crimp portion is oriented orthogonally relative to a plug connection direction of said sleeve portion.

4. A plug socket according to claim 1, wherein said crimp portion and said sleeve portion are a single piece bent from a plated blank.

5. A plug socket according to claim 1, wherein an inner surface of said crimp portion, in a region between said first and second clamping strips, is provided with a stop means for an end face of insulation of said cable.

6. A plug socket according to claim 5, wherein said stop means is embodied as a projection that extends transverse to a longitudinal axis of said cable.

7. A plug socket according to claim 6, wherein said stop means is a tongue that is cut free and bent out of said crimp portion.

8. A plug socket according to claim 1, wherein said hook-shaped projection is disposed in the vicinity of a front edge of said crimp portion that is directed toward an end face of said cable means.

9. A plug socket according to claim 8, wherein said hook-shaped projection is oriented orthogonally relative to said front edge of said crimp portion and parallel to said free edge of said first clamping strip, which free edge is disposed at an end face of said first clamping strip.

10. A plug socket according to claim 9, wherein said hook-shaped projection is formed by a cut-end and bending of a portion of a said front edge of said crimp portion.

11. A plug socket according to claim 9, wherein said hook-shaped projection is recessed relative to said front edge of said crimp portion, and wherein said free edge of said first clamping strip is provided with a portion that extends at an angle relative to said front edge of said crimp portion.

* * * * *